US006276112B1

(12) United States Patent
Mori et al.

(10) Patent No.: US 6,276,112 B1
(45) Date of Patent: Aug. 21, 2001

(54) CARTON SEALER

(75) Inventors: Kimihito Mori, Aichi; Hironobu Ohguri, Gumma, both of (JP)

(73) Assignees: Ushio-U-Tech Inc., Tokyo; Kabushiki Kaisha Kouki, Gumma, both of (JP)

( * ) Notice: Subject to any disclaimer, the term of this patent is extended or adjusted under 35 U.S.C. 154(b) by 0 days.

(21) Appl. No.: 09/582,674

(22) PCT Filed: Nov. 11, 1999

(86) PCT No.: PCT/JP99/06298

§ 371 Date: Jun. 28, 2000

§ 102(e) Date: Jun. 28, 2000

(51) Int. Cl.[7] ..... B65B 61/00
(52) U.S. Cl. ..... 53/136.4; 53/136.4; 53/412
(58) Field of Search ..... 53/136.4, 412; 156/443

(56) References Cited

U.S. PATENT DOCUMENTS 4,759,819 * 7/1988 Ingram ..... 156/443
4,821,487 * 4/1989 James et al. ..... 53/412
4,889,581 * 12/1989 Ulrich et al. ..... 53/136.4
5,184,997 * 2/1993 James et al. ..... 53/136.4

FOREIGN PATENT DOCUMENTS 54-98899 8/1979 (JP) .
4-68806 6/1992 (JP) .
9-58636 3/1997 (JP) .

* cited by examiner

*Primary Examiner*—Ira S. Lazarus
*Assistant Examiner*—Nathaniel C. Chukwurah
(74) *Attorney, Agent, or Firm*—Frishauf, Holtz, Goodman & Langer & Chick, P.C.

(57) ABSTRACT

A carton sealer is provided whereby a bent-back portion having non-sticky outer surfaces can be formed at a tip of an adhesive tape that is supplied in order to join flaps on a carton.

The carton sealer of the invention can join flaps on a carton that is conveyed by adhesive tape. The carton sealer comprises: a tape sticking mechanism that applies adhesive tape from an adhesive tape supply unit onto a sticking-on region extending from a lead region on a front face of an advancing carton, through a joining region extending in the conveying direction, to a tail region on the rear face of the carton, a cutter for cutting the rear end of the adhesive tape that has been applied, and a suction head that forms a bent-back portion at the head of the following tape formed by cutting. Reduced pressure subjected to the suction head acts on and applies suction to the non-sticky surface of the adhesive tape, thereby bending the adhesive tape back so as to form a bent-back portion having non-sticky outer surfaces.

5 Claims, 7 Drawing Sheets

CARTON SEALER

TECHNICAL FIELD

The present invention relates to a carton sealer for joining folded-in flaps of a carton made of cardboard using adhesive tape, in order to package such carton.

BACKGROUND ART

Conventionally, in order to package cardboard cartons, two flaps of the cartons are folded over into a condition in which the outer edges of these two flaps are mutually in contact or a condition in which they are mutually parallel, and these flaps are joined by sticking a single piece of adhesive tape on their joining region. Carton sealers are known that perform this task automatically. With a conventional carton sealer, the entire sticky surface of the adhesive tape is stuck onto the surface of the carton.

When a cardboard carton that has been sealed in this way is unsealed by hand, it is necessary, using one's nails for example, to start peeling off the end of the adhesive tape that has been stuck down, then to grip this part using the fingertips and pull it off. However, since the adhesion of the adhesive tape is fairly strong, such an operation is not easy.

Consequently, in fact, it is usual to perform the unsealing operation by using a cutting knife to cut the adhesive tape along the outside edge of the flaps. However, with such an unsealing operation, there is a risk of the cutting knife damaging the contents. Also, since the adhesive tape that has been cut is left behind, there is the problem that, when the cardboard is recycled, considerable time is required to peel off this adhesive tape that has been left behind.

In view of the above circumstances, it is extremely convenient if an end having non-sticky outside surfaces can be formed, so that for example the adhesive tape can be pulled off using the fingertips without using a cutting knife; further, recycling is facilitated if the entire adhesive tape can easily be completely removed, and this is very beneficial from the point of view of environmental protection.

In view of the above, previously, the means has been considered of sticking a non-adhesive sheet onto the adhesive surface at the tip of the adhesive tape; however, in this case, there are the problems that non-adhesive sheet materials must be separately prepared and furthermore this is lacking in practicality because the operation is not very reliable. A carton sealer has been developed in which a width-constricting guide member for bending back the side portions in the longitudinal direction on the adhesive tape is provided at some point along the running path of the adhesive tape, having the function of forming a non-adhesive bent-back portion by making the sticky faces adhere to each other. However, since the bent-back portions produced by this carton sealer extend along the entire length in the longitudinal direction of the adhesive tape that has been made to adhere, there is the drawback that it becomes impossible to use the entire sticky surface of the adhesive tape in the joining region, resulting in the reduced strength of the seal.

DISCLOSURE OF THE INVENTION

The present invention has been made in view of the above. An object thereof is to provide a carton sealer constituted so as to join by adhesive tape flaps that are folded in on a carton being conveyed, in which a bent-back portion having non-sticky outer surfaces can be formed easily and reliably at one end of the adhesive tape that is applied to the carton.

A carton sealer according to the present invention for joining bent-over flaps of a carton being conveyed with adhesive tape, comprises: an adhesive tape supply unit; a tape sticking mechanism that applies adhesive tape fed from the adhesive tape supply unit onto a sticking-on region which extends from lead region on the front face of an advancing carton, through a joining region extending in the conveying direction, to a tail region on the rear face of the carton; a cutter for cutting the rear end of the adhesive tape that has been applied; and a suction head for forming a bent-back portion at the head of the following tape formed by being cut by the cutter, wherein the adhesive tape is sucked in the suction head by the reduced pressure applied in the suction head on the non-sticky surface of the adhesive tape, whereby the adhesive tape is bent back to form a bent-back portion having non-sticky outer surfaces.

Preferably the tape sticking mechanism comprises: a front pressing roller that presses the sticky surface of a lead portion of the adhesive tape onto a lead region on the front face of the advancing carton, and then presses the sticky surface of the adhesive tape onto the joining region, as the carton advances, wherein the cutter is arranged at the downstream-side position of the front pressing roller in the direction of advance of the carton; and a rear pressing roller arranged further on the downstream-side position of the cutter in the direction of advance of the carton, that presses the sticky surface of the tail portion of the adhesive tape that has been cut by the cutter onto a tail region on the rear face of the carton; the cutter being provided on a swing plate that is swung when its tip is detached from the joining region of the carton, and the suction head is provided at the upstream-side position of the cutter in the direction of advance of the carton.

It is further preferable that the suction head has a suction port arranged in the vicinity of the cutter on the upstream side of the cutter in the direction of advance of the carton and faces the non-sticky surface of the running adhesive tape, and a slit formed continuously with the suction port and extending in the direction away from the non-sticky surface of the running adhesive tape wherein a reduced pressure acts on the slit.

It is further preferable that an induction portion is formed in the suction head continuously with an aperture constituting the suction port such that its width gradually decreases and the slit is formed continuously with the induction portion, and a reduced pressure chamber is formed continuously with the slit.

With a carton sealer according to the present invention, while sealing of a carton by adhesive tape can be automatically achieved, a bent-back portion having non-sticky outer surfaces is formed at the tip of the part of the adhesive tape that is applied onto the lead region on the front face of the carton to be sealed. Consequently, by gripping the bent-back portion with the fingers, the stuck adhesive tape can easily be peeled off and furthermore, as a practically inevitable result, the entire adhesive tape is removed.

EXPLANATION OF THE REFERENCE SYMBOLS

Figure 1:
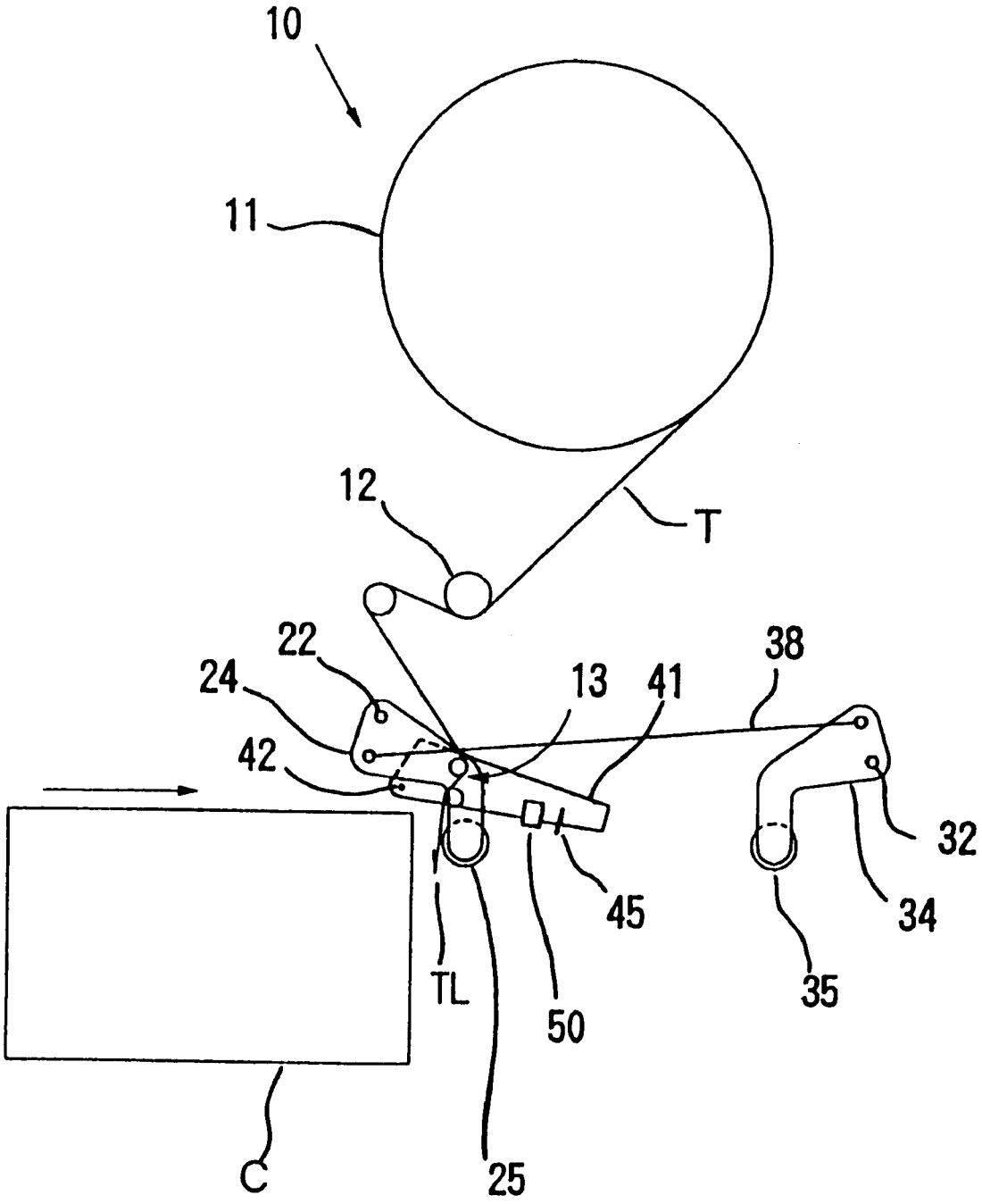
FIG. 1 is an explanatory view of the construction of an example of a carton sealer according to the present invention.

C carton
11 tape roll
12 tape guide roller
13 working rollers
22 support shaft
24 rotary plate
25 front pressing roller
32 support shaft
34 rotary plate
35 rear pressing roller
38 link bar
41 swing plate
42 support shaft
45 cutter
50 suction head
51 block
52 aperture
53 wall face
54 slit
58 reduced pressure channel

BEST MODE FOR CARRYING OUT THE INVENTION

A specific description of a carton sealer according to the present invention is given below.

FIG. 1 is an explanatory view illustrating diagrammatically the construction of an example of a carton sealer according to the present invention. In the Figures, 10 indicates a carton sealer, C a carton to be sealed, 11 a tape roll constituting an adhesive tape supply unit, and 12,13 tape guide rollers.

The carton sealer 10 of this example joins the sealing areas of the two flaps that are bent over so as to form the upper surface wall of carton C, by applying or sticking adhesive tape onto them.

A carton C is fed and conveyed in the direction toward right in this Figure along a conveying path extending in the horizontal direction, constituted by, for example, freely rotatable rollers, by means of a conveyer mechanism (not shown) comprising a belt, for example.

A tape roll 11 is supported on a tape reel (not shown) that is free for rotation in the tape feeding direction but whose rotation is prevented in the reverse direction, being wound in the form of a roll such that the non-sticky surface is outermost. The adhesive tape T fed out from the tape roll 11 is supplied to a tape sticking mechanism via a tape guide roller 12 and working rollers 13.

The tape sticking mechanism comprises a front pressing mechanism having a front pressing roller 25, a rear pressing mechanism having a rear pressing roller 35, and a cutter mechanism having a cutter 45.

The front pressing mechanism comprises an approximately L-shaped rotary plate 24. This rotary plate 24 has a main portion extending in the direction of advance of the carton C and a tip portion extending downwards from the tip thereof. The main portion is arranged to be freely rotatable about a horizontal support shaft 22, and the front pressing roller 25 is rotatably supported on the tip portion.

In the free condition in which there is no contact with the carton C, the front pressing roller 25 is restrained by the action of a spring, not shown, so as to be positioned at a level below the upper surface of the advancing carton C.

The rear pressing mechanism comprises an approximately L-shaped rotary plate 34. This rotary plate 34 has a main portion extending in the direction opposite to the direction of advance of the carton C and a tip portion extending downwards from the tip thereof. The main portion is arranged to be freely rotatable about a horizontal support shaft 32, and the rear pressing roller 35 is rotatably supported on the tip portion.

The rotary plate 24 of the front pressing mechanism and the rotary plate 34 of the rear pressing mechanism are linked by a link bar 38 such that the front pressing roller 25 and the rear pressing roller 35 are both maintained on the same level, and if one is raised or lowered the other is likewise raised or lowered. Consequently, the rear pressing mechanism is maintained such that the rear pressing roller 35 is positioned at a level below the upper surface of the advancing carton C, by means of the spring acting on the front pressing mechanism, in the free condition in which the carton C is not in contact with the front pressing roller 25.

The cutter mechanism is provided with a swing plate 41 which, as a whole, extends in the direction of advance of the carton C. The base end (left end in the Figure) of the swing plate 41 is arranged to be freely rotatable about a horizontal support shaft 42, while its tip (right end in the Figure) is biased downwards by a spring, not shown. A cutter 45 having a saw tooth-shaped cutting blade, for example, on its lower edge is fixed at its tip, and a suction head 50 is arranged in the vicinity on the upstream-side (opposite direction to the direction of advance of the carton C) of this cutter 45.

Figure 2:
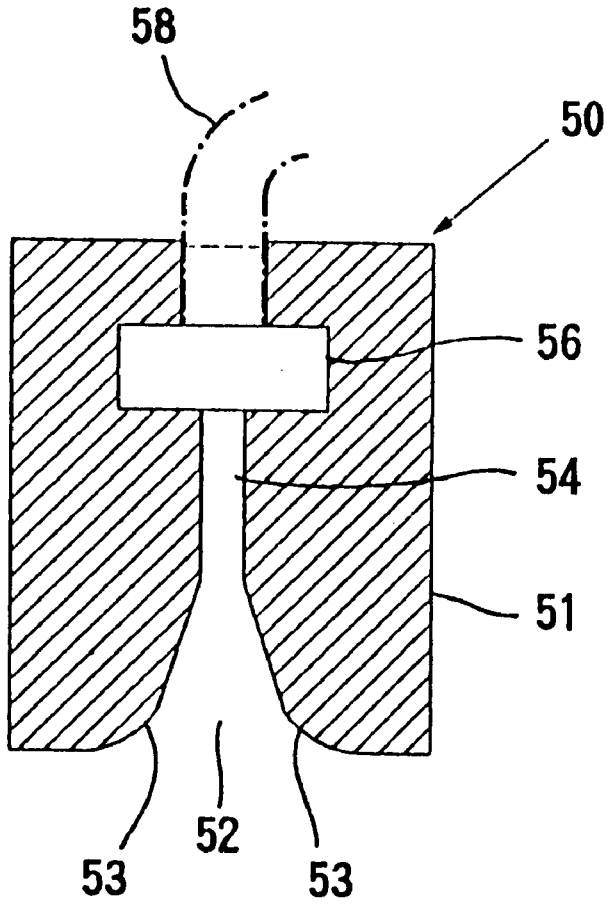
FIG. 2 is a cross sectional view given in explanation of the suction head.

FIG. 2 is a cross-sectional view given in explanation of suction head 50. The suction head 50 consists of a metallic block 51 made for example of aluminum having an aperture 52 that forms a suction port on its under-surface, an induction portion width of which gradually decreases as it extends upwards continuing from the aperture 52, and a slit 54 of fixed width continuing from the induction portion. The suction head 50 has a reduced pressure chamber 56 in the upper part of the metallic block 51 so that the top of the slit 54 is continued to the reduced pressure chamber 56 and a reduced pressure channel 58 extending from a vacuum pump, not shown, is connected to the reduced pressure chamber 56.

In the example illustrated, wall surfaces 53, 53 on the entrance side and exit side of the aperture 52 of the suction head 50 each has a shape that is bent into a smooth arc.

The shape of the aperture 52 and the shape and dimensions of the depth and gap width of the slit 54 in the suction head 50, the magnitude of the applied reduced pressure and the positional relationship with cutter 45 etc may be set within a wide range depending on the type and/or dimensions of the adhesive tape employed, and other conditions.

The operation of the carton sealer 10 having a construction as above is as follows.

FIG. 1 shows the condition after processing of a preceding carton (not shown) has been completed, immediately before the sealing processing of the next or present carton C is commenced. In this condition, since the adhesive tape T is supported by the working rollers 13 as it is fed out from the tape roll 11, its lead portion TL is put in a hanging-down condition at the front of the carton C, while its sticky surface is put in a condition facing the front face of the carton C with the front pressing roller 25 positioned behind the lead portion TL.

When the carton C is advanced by the operation of the conveyer mechanism, the lead portion TL of the adhesive tape T is pressed by the front pressing roller 25 to stick onto the lead region on the front face of the carton C. When the carton C is advanced further, since the front pressing roller 25 is pressed by the advancing force of the carton C as it advances, the rotary plate 24 of the front pressing mechanism is rotated anti-clockwise against the spring so that its tip portion rises up about the support shaft 22, causing the front pressing roller 25 to rise on the front face of carton C keeping a contacting state thereto. As a result, the lead portion TL of the adhesive tape T is stuck onto the lead region on the front face of the carton C. At this stage, the rotary plate 34 of the rear pressing mechanism is rotated clockwise so that its tip portion rises up about the support shaft 32 by means of the link bar 38.

Figure 3:
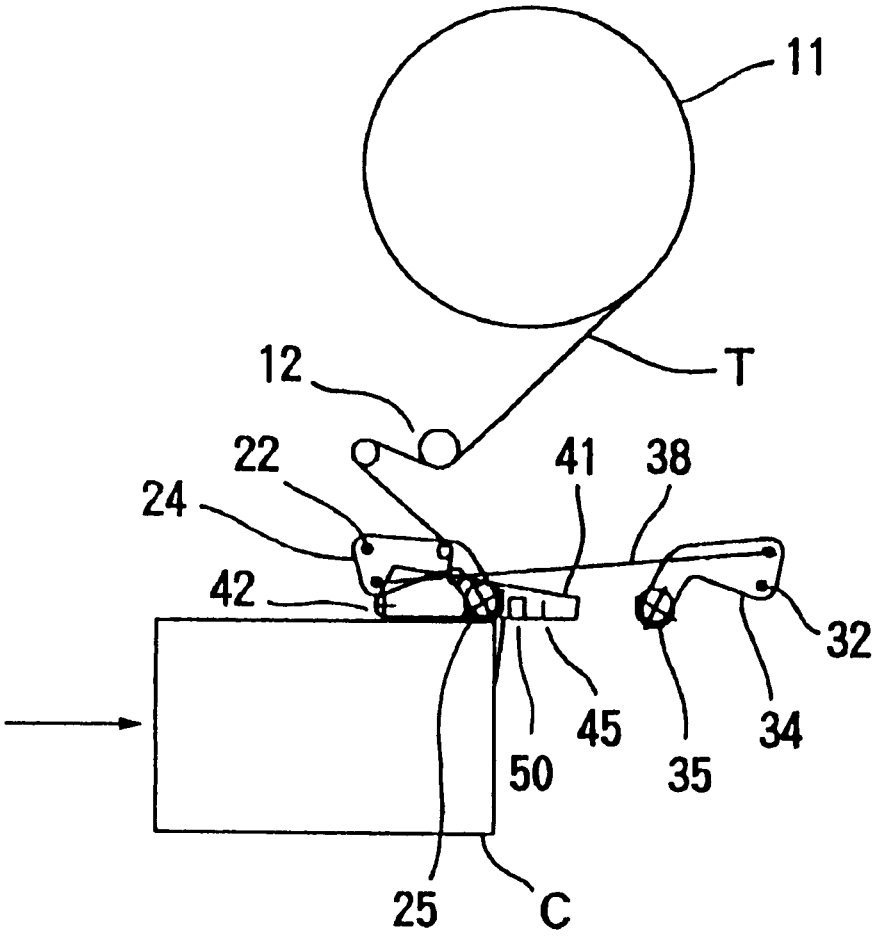
FIG. 3 is an explanatory view illustrating the condition in which the front pressing roller of the carton sealer of FIG. 1 is positioned on the upper face of the carton.

Next, as shown in FIG. 3, when the front pressing mechanism 25 reaches on the top face of the carton C, as the carton C advances, the adhesive tape T is fed out from the tape roll 11 by its force of advance so that the succeeding portion thereof is pressed against the upper surface of the carton C by the front pressing roller 25 which is biased downwards by the action of the spring and, further, by this downwards pressure, the adhesive tape T is stuck onto the joining region that extends in the conveying direction on the upper surface of the carton C.

Figure 4:
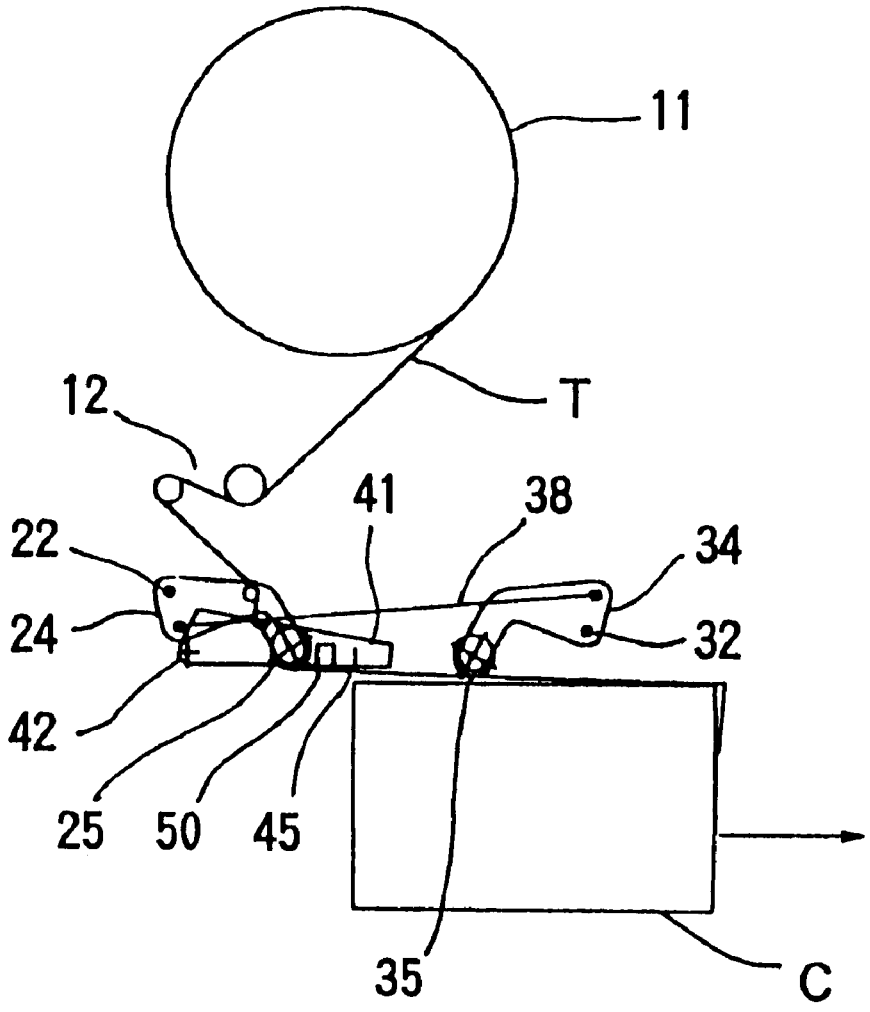
FIG. 4 is an explanatory view illustrating the condition immediately prior to detachment of the swing plate of the carton sealer from the upper surface of the carton.
Figure 5:
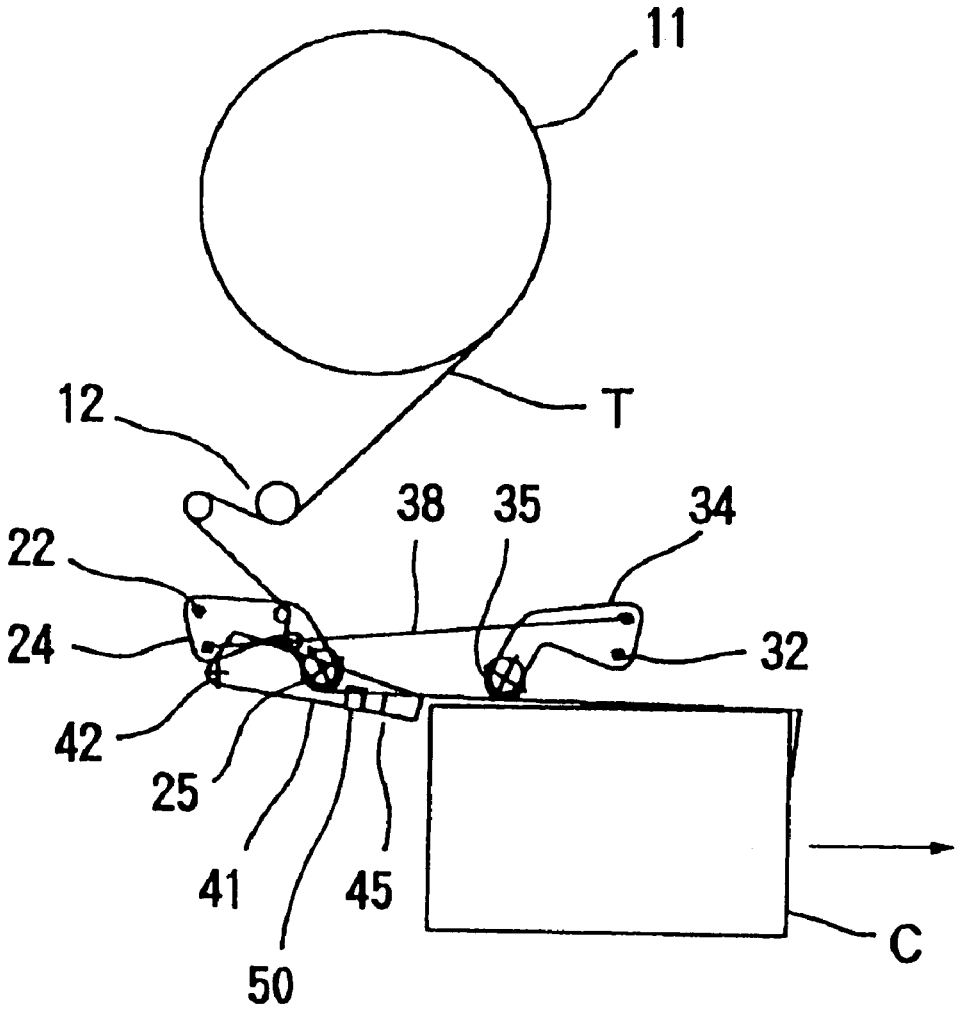
FIG. 5 is an explanatory view illustrating the condition immediately after detachment of the swing plate of the carton sealer from the upper surface of the carton.

Furthermore, as shown in FIG. 4, the adhesive tape T that has been stuck onto the joining region is subjected to downwards pressing force again by the rear pressing roller 35 which follows.

At this state, the tip of the swing plate 41 of the cutter mechanism is put in a raised position supported by the upper surface of the carton C, and the cutter 45, which is positioned in the vicinity of the tip thereof is in an inoperative condition with respect to the adhesive tape T.

As the carton C advances further, as shown in FIG. mechanism comes away from the rear edge of the upper surface of the carton C, the swing plate 41 is rotated by the action of the spring, causing its tip to descend. In this way, as shown in FIG. 7(i), the cutter 45 operates across the adhesive tape T that is tensioned between the tape guide rollers 13 and the advancing carton C, thereby cutting the adhesive tape T, with the result that a tail portion TT of the adhesive tape T is formed and a lead portion of the following adhesive tape T is formed.

Figure 6:
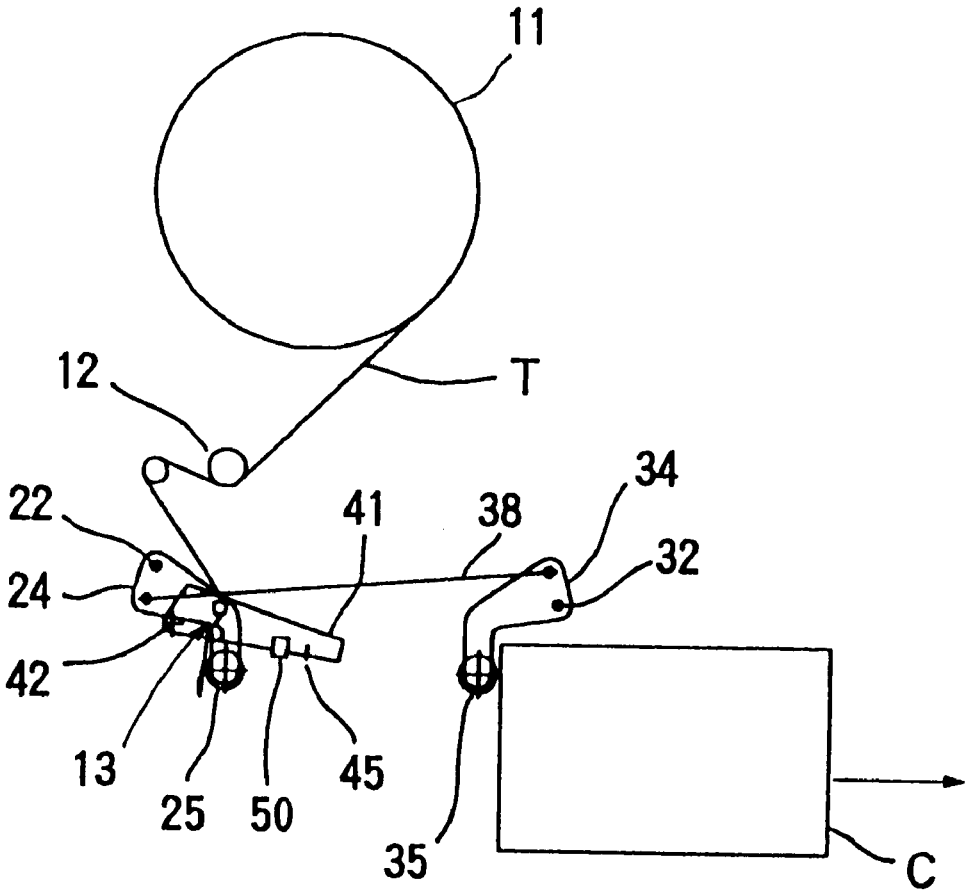
FIG. 6 is an explanatory view illustrating the condition after the rear pressing roller of the carton sealer has been detached from the upper surface of the carton.

Thereafter, as shown in FIG. 6, when further advance of the carton C causes the rear pressing roller 35 to come away from the rear edge of the upper surface of the carton C, the rotary plate 34 is rotated in the anti-clockwise direction by the action of the spring that acts on the front pressing mechanism. The rear pressing roller 35 thereby presses the tail portion TT of the adhesive tape T to the rear face of the carton C, so that the tail portion TT is stuck onto the tail region on the rear face of the carton C.

In the carton sealer 10 constructed as above, a folded back portion is formed in the following manner at the tip of the following adhesive tape T after cutting, by the suction head 50 provided on the swing plate 41 of the cutter mechanism and located close to the downstream-side position of the cutter 45.

Figure 7I:
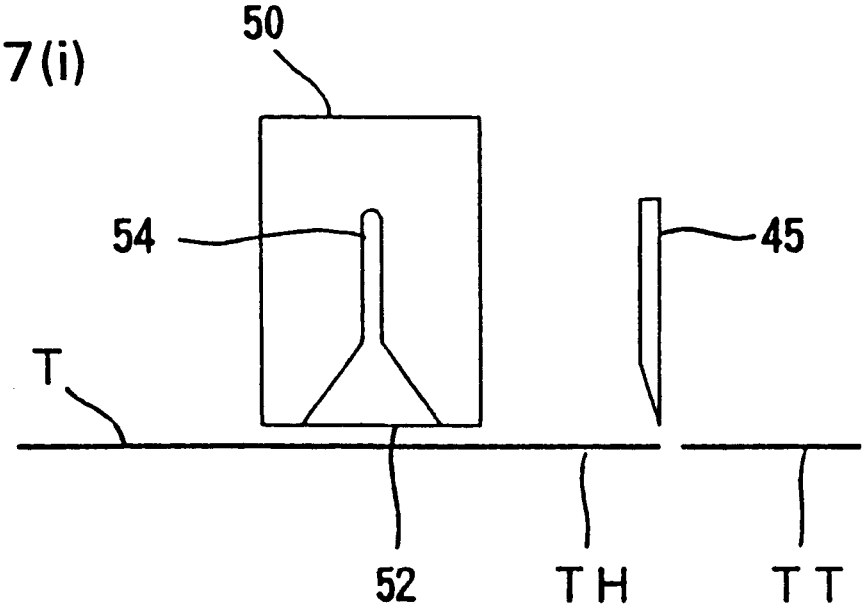
FIG. 7(i) is a cross sectional explanatory view illustrating the condition of the suction head of FIG. 2 at the instant that the adhesive tape has been cut by the cutter, and FIG. 7(ii) is a cross sectional explanatory view illustrating the operation of the suction head.

FIG. 7(i) is an explanatory view showing the condition immediately after the adhesive tape T has been cut by the cutter 45. The tail portion TT of the advancing adhesive tape is processed by the rear pressing roller 35 as described above.

On the other hand, the head portion TH of the following adhesive tape T is in a free condition, because the adhesive tape T is only adhesively held by the working rollers 13 at its upper-stream position. Consequently, if the head portion TH is left as it is, the portion TH would hang down due to the gravity.

Figure 7:
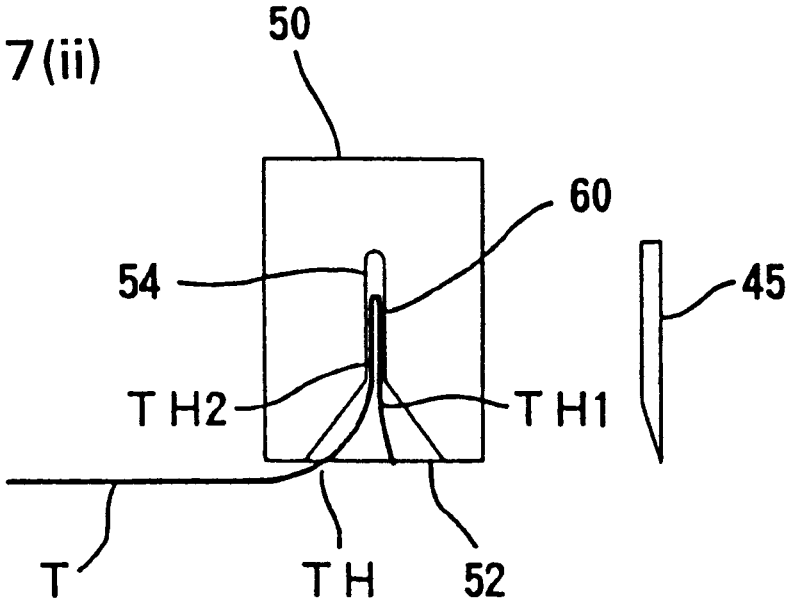

However, as reduced pressure is applied to act on the suction head 50 through the reduced pressure channel 58 simultaneously with the cutting of the adhesive tape T or immediately thereafter, the head portion TH is sucked into the slit 54 from the aperture 52 with its middle portion constituting the head or apex of the sucked portion, as shown in FIG. 7(ii), since the aperture 52 of the under-surface of the suction head 50 faces the non-sticky surface of the head portion TH of the adhesive tape and the reduced pressure applied to the reduced pressure chamber 56 reaches the aperture 52 through the slit 54.

Since the slit 54 decreases in its width as it extends upwards, the head portion TH that has been sucked into the slit 54 is folded such that the leading half TH1 thereof is bent back onto the following portion TH2. Since the inner surfaces of bent-back portions TH1 and TH2 that are mutually in contact are sticky surfaces, these two mutually stick together, with the result that in the bent-back portion 60 thus formed has non-sticky outer surfaces with the sticky surfaces being covered.

When the reduced pressure action is stopped thereafter, the lead portion TL of the adhesive tape T having the bent-back portion 60 thus formed drops down from the suction head 50, and is held by the working rollers 13 in a prescribed position to be ready for sealing the following carton.

In this way, the adhesive tape T that is employed for the next carton is provided at its tip with a bent-back portion 60 having non-sticky outer surfaces.

Consequently, when unsealing a carton that has been package-sealed with the adhesive tape T having the bent-back portion 60, the adhesive tape T stuck on can very easily be peeled off in its longitudinal direction by gripping the bent-back portion 60 between the fingers. As a result, in most cases, all of the stuck adhesive tape T may be removed inevitably, it is extremely convenient for recycling the cartons and presents no obstacle to environmental protection.

Although the magnitude of the reduced pressure to be applied to the suction head 50 may not be generally prescribed because it differs depending on the type of the adhesive tape T employed and the size of its width and other conditions, it is for example 400~750 mm/Hg in some cases.

The dimension of the opening width d of the aperture 52 of the suction head 50 may be about 5–10 mm, for example. If the opening width is made larger, the magnitude of the applied pressure reduction should be made greater.

The length of the bent-back portion 60 of the adhesive tape T varies depending on the distance between the cutter 45 and the suction head 50, the depth and shape of the slit 54 and other conditions, and accordingly it can be adjusted by selecting proper conditions. In practice, it may be sufficient if the length of the bent-back portion 60 is in the range of 5–15 mm for example, and in this case, the length of the slit 54, including the aperture 52, would be about 10–20 mm.

A specific example of the present invention has been described above, and the present invention may be modified in various ways. For example, the specific construction of the carton sealer body is not restricted to that of the example illustrated. The joining region where the adhesive tape is to be applied is not suction head can be applied in the same way even if the joining region is positioned at the side face or bottom face of a carton.

EFFECT OF THE INVENTION

As described above, with a carton sealer according to the present invention, while sealing of a carton by adhesive tape can be automatically achieved, a bent-back portion having non-sticky outer surfaces is formed at the tip of the part of the adhesive tape that is applied onto the lead region on the front race of the carton to be sealed. Consequently, by gripping the bent-back portion with the fingers or the like, the stuck adhesive tape can easily be peeled off and furthermore, as a practically inevitable result, the entire adhesive tape is removed. This is convenient for recycling and is desirable from the point of view of environmental protection.

What is claimed is:

1. A carton sealer for joining bent-over flaps of a carton being conveyed with adhesive tape, comprising:

an adhesive tape supply unit;

a tape sticking mechanism that applies adhesive tape fed from the adhesive tape supply unit onto a sticking-on region which extends from a lead region on the front face of an advancing carton, through a joining region extending in the conveying direction, to a tail region on the rear face of the carton;

a cutter for cutting the rear end of the adhesive tape that has been applied; and a suction head for forming a bent-back portion at the head of the following tape formed by being cut by the cutter;

wherein:

the adhesive tape is sucked in the suction head by the reduced pressure applied in the suction head on the non-sticky surface of the adhesive tape, whereby the adhesive tape is bent back to form a bent-back portion having non-sticky outer surfaces.

2. The carton sealer according to claim 1, wherein:

the tape sticking mechanism comprises: a front pressing roller that presses the sticky surface of a lead portion of the adhesive tape onto a lead region on the front face of the advancing carton, and then presses the sticky surface of the adhesive tape onto the joining region, as the carton advances, wherein the cutter is arranged at the downstream-side position of the front pressing roller in the direction of advance of the carton; and a rear pressing roller arranged further on the downstream-side position of the cutter in the direction of advance of the carton, that presses the sticky surface of the tail portion of the adhesive tape that has been cut by the cutter onto a tail region on the rear face of the carton;

the cutter being provided on a swing plate that is swung when its tip is detached from the joining region of the carton, and the suction head is provided at the upstream-side position of the cutter in the direction of advance of the carton.

3. The carton sealer according to claim 2, wherein:

the suction head has a suction port arranged in the vicinity of the cutter on the upstream side of the carton in the direction of advance of the cutter and faces the non-sticky surface of the running adhesive tape, and a slit formed continuously with the suction port and extending in the direction away from the non-sticky surface of the running adhesive tape wherein a reduced pressure acts on the slit.

4. The carton sealer according to claim 1 wherein:

the suction head has a suction port arranged in the vicinity of the cutter on the upstream side of the cutter in the direction of advance of the carton and faces the non-sticky surface of the running adhesive tape, and a slit formed continuously with the suction port and extending in the direction away from the non-sticky surface of the running adhesive tape wherein a reduced pressure acts on the slit.

5. The carton sealer according to claim 4, wherein:

an induction portion is formed in the suction head continuously with an aperture constituting the suction port such that its width gradually decreases and the slit is formed continuously with the induction portion; and a reduced pressure chamber is formed continuously on the slit.

* * * * *